US006516864B2

(12) United States Patent
Ounjian et al.

(10) Patent No.: US 6,516,864 B2
(45) Date of Patent: Feb. 11, 2003

(54) GEM SETTING METHOD AND TOOL

(76) Inventors: Harout Ounjian, 30974 Sturbridge, Farmington Hills, MI (US) 48331; Avo Ounjian, 30974 Sturbridge, Farmington Hills, MI (US) 48331

( * ) Notice: Subject to any disclaimer, the term of this patent is extended or adjusted under 35 U.S.C. 154(b) by 0 days.

(21) Appl. No.: 09/828,045

(22) Filed: Apr. 6, 2001

(65) Prior Publication Data

US 2002/0144798 A1 Oct. 10, 2002

(51) Int. Cl.[7] ..... B22C 9/02

(52) U.S. Cl. ..... 164/35; 164/34; 164/9; 164/10

(58) Field of Search ..... 164/35, 9, 10, 164/34

(56) References Cited

U.S. PATENT DOCUMENTS

| | | | | |
|---|---|---|---|---|
| 3,601,178 A | | 8/1971 | Marticorena | |
| 3,712,079 A | | 1/1973 | Eberle | |
| 4,154,282 A | | 5/1979 | Kull | |
| 4,392,289 A | * | 7/1983 | Michaud | 164/35 |
| 5,548,976 A | | 8/1996 | Slowinski | |
| 5,690,477 A | | 11/1997 | Haimoff | |
| 5,718,278 A | | 2/1998 | Baum | |
| 5,881,795 A | | 3/1999 | Uptain | |
| 5,916,271 A | | 6/1999 | Baum | |
| 6,006,547 A | | 12/1999 | Bergagnini | |
| 6,123,141 A | | 9/2000 | Baum | |
| 6,149,354 A | * | 11/2000 | Walters | 407/42 |

* cited by examiner

*Primary Examiner*—Tom Dunn
*Assistant Examiner*—I.-H. Lin
(74) *Attorney, Agent, or Firm*—Reising, Ethington, Barnes, Kisselle, Learman & McCulloch, PC

(57) ABSTRACT

A tool (40) has a ledge portion (46) and a cutting blade portion (50) for cutting a groove (24, 26, 28) in a wax model (32) for an article of jewelry. The groove is formed after the wax model is formed by mechanical removal of the wax, preferably by cutting with tool (40). The wax model and gems are then placed in an investment mold where the lost wax technique is used to form an article of jewelry with the gems set therein.

5 Claims, 2 Drawing Sheets

GEM SETTING METHOD AND TOOL

TECHNICAL FIELD

The field of this invention relates to a method of manufacture for producing an article of jewelry made from precious metal and one or more gems and a tool for creating the seats for the gems in the wax model.

BACKGROUND OF THE DISCLOSURE

Gem setting directly into precious metal has long been known to be expensive and a time consuming process. Efforts have been made to mass produce articles of jewelry with using the lost wax process and eliminating the need for setting gems directly into an article of precious metal.

U.S. Pat. No. 4,392,289 issued on Jul. 12, 1983 to Michaud provided for a molding technique for jewelry where a rubber mold is formed to produce a wax model with a seat formed by molded grooves. The diamond or other gem such as a ruby or sapphire is then set in the grooves. An investment material surrounds the wax model and gem in preparation of making a cast about the gem via the lost wax process. The investment forms a hardened shell about the model and gems and the wax is melted and drained. The gem remains in position and retained by the surrounding investment. Molten precious metal is then cast into the formed cavity where the wax model use to be. After the molten metal is allowed to solidify, the article of jewelry is then devested, with the sprues and gates removed. The article is then ready to be polished. The gem is mounted in the precious metal in the same position as it was in the wax model. Gems such as diamonds, rubies and sapphires are not harmed by the heat commonly used in the lost wax and casting process.

This method has seen commercial success and many different types of jewelry from rings to pendants have used this casting method. However, this method has several disadvantages and complexities. Firstly, because the vertical position and the depth of the molded grooves are preset in the rubber mold and thus also preset in the wax model, great care must be used to find diamonds and other gems that are sized to fit the preset grooves. In theory, the above process succeeds if all the gems are within the design manufacturing tolerances for the molded wax model. In other words, with the known mold with the preset molded grooves, the gems must be sized to fit the wax model.

However, in practicality, one usually has certain available gems which must be fitted into a wax model. If one has a several gems of different sizes, the wax model made with preset uniform grooves is incompatible for use with the existing gems. In other words, it is desired that the wax model accommodates the existing or desired gems. This accommodation is particularly desirable when a piece of jewelry has multiple gem stones and each gem stone is sized slightly different. It is preferable that the top of all the gem stones be level in many types of popular channel designs. However, it is expensive to form a rubber mold for each set of pre-existing gems with a preset molded groove. One would end up with many rubber molds for each model of jewelry.

It is desirable to have a rubber mold form a wax model without the preset grooves and then have the wax mechanically removed by a tool that precisely locates each groove for each gem stone such that the gems are precisely positioned to present aligned upper facets. After the grooves are then formed, the lost wax method of casting gold or other precious metal with the gems may then proceed.

What is needed is a tool that allows this method of mechanically removing wax to form the grooves for seating gems.

SUMMARY OF THE DISCLOSURE

In accordance with one aspect of the invention, a method of manufacturing an article of jewelry includes the steps of forming a wax model having opposing retaining walls that form a channel for seating a gem therein. The wax model has a certain degree of resiliency enabling flexing of the retaining walls to allow entry of a gem into the channel. Mechanical removal of the wax material occurs to form opposing grooves in the channel. Preferably, the wax is cut away to form the opposing grooves in the opposing retaining walls of the formed wax model. The grooves engage a girdle of a gem below a distal edge of the retaining walls. The gem is snapped into the channel to allow the girdle to enter into engagement into the seating grooves. A hard investment mold is formed about the gem and wax model. The lost wax process is then used to replace the wax model with cast precious metal within the investment mold. The investment mold is then devested from the formed article of jewelry with the set gem mounted thereto.

Preferably, a cutting tool is used to cut the groove, the groove has side walls angled to follow the contour of the girdle of the gem.

It is also desirable to slide a positioning ledge of the tool along the distal edge of the retaining wall and have a blade distal blade section of the tool cut into said retaining wall below the distal edge to form the grooves. In one embodiment, the tool slides a sufficient distance to cut a groove sufficiently long to seat a plurality of gem stones in a row.

In accordance with another aspect of the invention, a tool is used for forming an undercut groove seat in a wax model for retaining a gem stone in place on the wax model. The tool comprises a handle section a bit with a ledge, a recess leg section, and blade section. The bit extends from the handle. The ledge section is smooth and preferably with smooth rounded edges for sliding on a distal end of a retaining wall. The recess leg portion extends below the ledge portion. A side extending blade portion is at a distal section of the leg for cutting the wax away and to form an undercut groove spaced below the distal end of the retaining wall.

Preferably, the side extending blade portion is tapered with canted cutting edges that conforms to the contour of a girdle portion of a gem. It is also preferable that the ledge is substantially flat to promote a orthogonal seating of the tool on the distal end of the retaining wall. The ledge has rounded edges to prevent the ledge from cutting into the distal end of the retaining wall. In one embodiment, the ledge has an extended portion from the bit portion interposed between the handle and the ledge.

BRIEF DESCRIPTION OF THE DRAWINGS

Reference now is made to the accompanying drawings in which.

DETAILED DESCRIPTION OF THE PREFERRED EMBODIMENT

Figure 1:
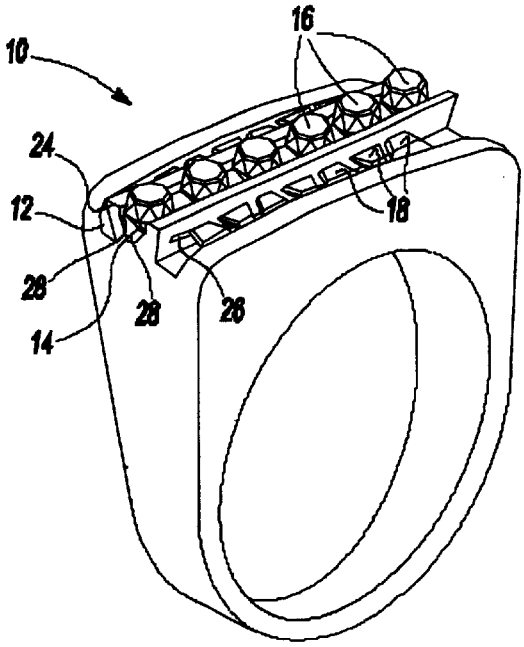
FIG. 1 is a perspective view of an article of jewelry made by a method in accordance with the invention.

Referring now to FIG. 1, a representative piece of jewelry 10 is shown with several side channels 12 and a central raised channel 14 with gems 16 and 18 set therein. Each gem 16 and 18 has its respective girdle 20 and 22 seated in opposing grooves 24, 26 and 28. Gems 16 are illustrated to have a round cut and gems 18 are illustrated to have a baguette cut. However, the invention equally applies to any gem cut that produces a girdle for the gem stone. The jewelry is made from a novel lost wax process and with the grooves formed by a novel tool between the formation a wax model and the investment mold being formed.

Figure 2:
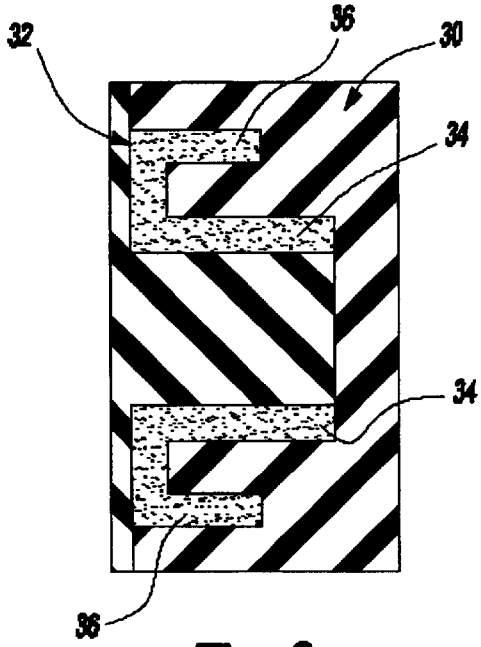
FIG. 2 is a fragmentary sectional view of a rubber mold made from a master with a wax casting therein.
Figure 3:
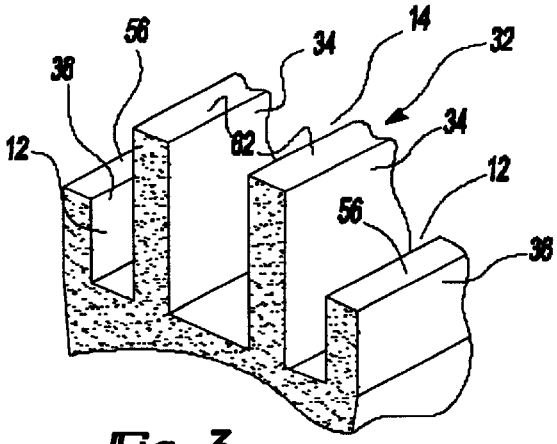
FIG. 3 is an fragmentary and enlarged perspective view of the channel section of the formed wax model.

As shown in FIG. 2, a rubber mold 30 is conventionally made from a master model (not shown). The master model and thus the rubber mold 30 have all the design and structure except for the seats or undercut grooves as formed and described later. Thus the formed wax model 32 as shown in FIGS. 2 and 3 have corresponding side channels 12 and central channel 14 formed by retaining walls 34 and 36. The wax model 32 may have conveniently formed sprues and gates attached thereto, not shown for simplicity of the drawing.

Figure 4:
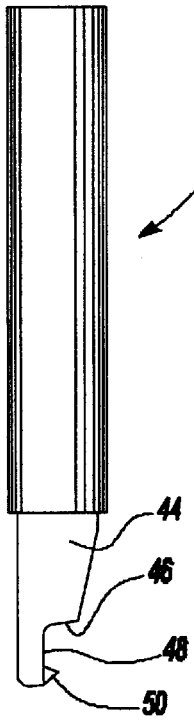
FIG. 4 is a side elevational view of tool in accordance with the invention.
Figure 5:
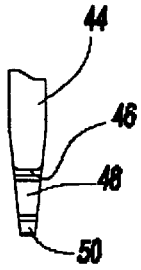
FIG. 5 is a front plan view of the bit of the tool shown in FIG. 4.
Figure 6:
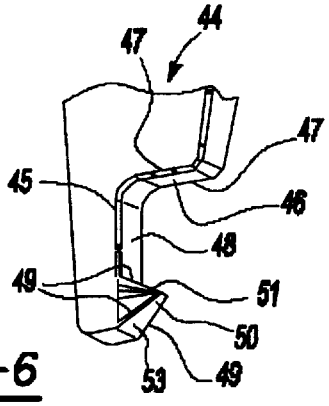
FIG. 6 is an enlarged perspective view of the bit of the tool shown in FIG. 4.

A tool 40 as shown in FIG. 4 has a handle 42 for manual grasping and manipulation and a bit 44 for cutting grooves or seats 24, 26 & 28 to seat the gems 16 and 18. The bit 44 includes a smooth ledge section 46 leading to a recess 48 and a cutting blade section 50. The ledge section 46 has rounded edges 47 to prevent accidental cutting or gouging of the wax model. Similarly recess 48 has rounded edges 45. The blade section 50 is pointed and with sharp edges 49 to provide for an angle cut that corresponds to the girdle cut for the desired gem. For example, the top slope 51 may have a 35° cant, the bottom slope 53 may have a 41° cant to accommodate most well cut round diamonds. Its depth may vary from ¼ mm to ¾ mm to accommodate stones up to ¼ caret round. The pointed cutting blade section 50 is spaced below the ledge section 46 a predetermined amount with a minimum distance being about 0.4 mm to provide sufficient amount of metal strength in the channel retaining wall to retain the gem stones. Different tools can be incorporated in a set to have different cutting tips for different gem cuts and for different vertical positioning of the groove or seat 24, 26, and 28.

Figure 7:
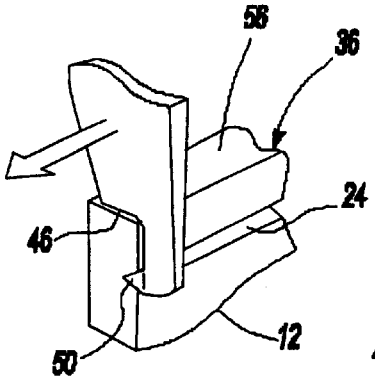
FIG. 7 is a view of one channel retaining wall being grooved with the tool shown in FIG. 4.

Referring now to FIG. 7, the tool 40 is then positioned such that the ledge section 46 rests on the distal upper face 56 of the retaining wall 36. The tool is slid along the retaining wall such that the cutting blade section 50 cuts a groove 24 below the distal upper face 56 facing channel 12. The groove 24 may be typically positioned about 0.4 mm below the distal upper face 56 and be about 0.2 mm deep in order to retain the gem stone in a proper position.

Figure 8:
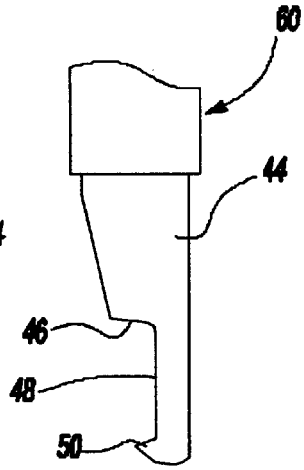
FIG. 8 is a fragmentary side elevational view of a tool sized to create a vertically lower positioned groove on a different channel retaining wall.
Figure 9:
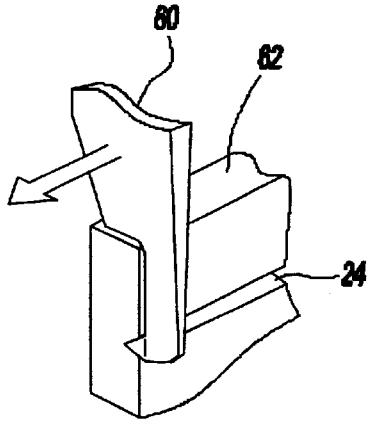
FIG. 9 is a view of another channel retaining wall being grooved with the tool shown in FIG. 8.

As shown in FIGS. 8 and 9, a second tool 60 has a similar handle and cutting blade but the cutting blade 50 is positioned substantially farther away from ledge section 46 forming a larger recess 48 in order to compensate for the taller retaining wall 34. As such tool 60 slides across upper distal face 62 of wall 34 to form groove or seat 26 that opposes groove or seat 24.

The tool 40 can then be used to cut grooves 28 in the central channel 14. The tool has the cutting blade pointed to correspond to the girdle of the round cut diamond.

Figure 10:
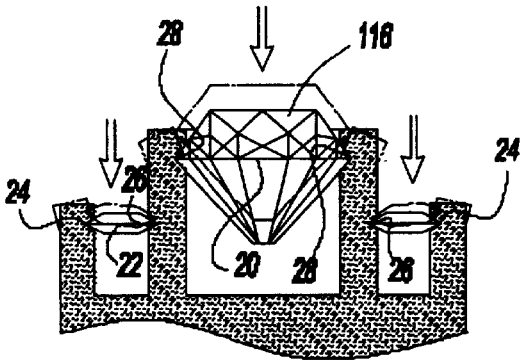
FIG. 10 is an enlarged sectional view of the channel section of the wax model showing the gems being snap fitted into the wax model at the formed grooves or seats.

After the grooves 24, 26 and 28 are cut into the wax model, the gems are then snap fitted into place to be seated in the grooves 24, 26 and 28 as illustrated in FIG. 10. The retaining walls 34 and 36 each have a certain give and resiliency to allow the girdles 20 and 22 of the gems to move into the channels 12 and 14 and be seated into the grooves 24, 26 and 28.

Figure 12:
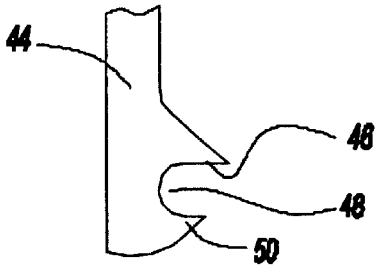
FIG. 12 is a side elevational view of an alternative embodiment of a tool bit in accordance with the invention.

FIG. 12 discloses a modified bit 44 where the ledge section 46 is extended beyond the rest of bit 40. While the tools 40 and 60 are disclosed with a sideways extending cutting blade section 50 and a ledge 46 that is substantially transverse or slightly canted to provide a substantially upright position of the handle 42 as the tool slides over the upper distal edge of the retaining wall, other modifications are foreseen. The cutting blade may be more aligned with the handle 42 where the handle is disposed more horizontally with respect to the retaining walls. Other variations are foreseen where the ledge rides on one distal end of one retaining wall while the cutting blade section may cut a groove in an adjoining retaining wall.

Figure 11:
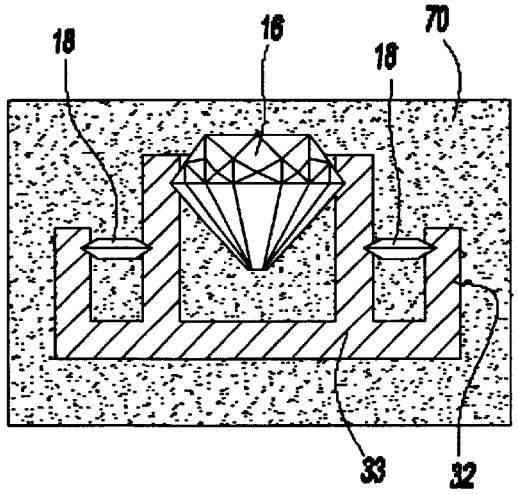
FIG. 11 is an enlarge fragmentary sectional view of the investment mold showing the gem stones retained in position after the wax model is melted and removed and prepared to receive poured precious metal.

The investment mold 70 is then formed about the gems and wax model. The lost wax process then proceeds. The investment mold 70 is properly hardened, and the wax model 32 is melted and drained. The gems are retained in place as shown in FIG. 11 by the investment mold 70 formed thereabout before the removal of the lost wax model 32. The girdles 20 and 22 of the gems extend into cavity 33 formed by the lost wax model 32.

The lost wax process then proceeds with the conventional casting of precious metal. After the metal is cast, the formed article is then devested from the investment mold. The formed metal sprues and gates are also conventionally removed to form the finished piece of jewelry as shown in FIG. 1.

As can be determined, it is possible to change heights of the grooves 24, 26 and 28 longitudinally along the retaining walls 34 and 36 to precisely accommodate variations in vertical height of the individual gems such that their upper facets are precisely aligned horizontally along the channel 12 or 14. Secondly, the tools can accommodate different cuts or different gems and provide grooves that are angled to the contour of the girdle of the individual gems.

In this fashion, the lost wax process can now accommodate or conform to the available gems rather than finding gems that fit within the manufacturing tolerances of the previous lost wax processes.

Variations and modifications are possible without departing from the scope and spirit of the present invention as defined by the appended claims.

The embodiments in which an exclusive property or privilege is claimed are defined as follows:

1. The method of manufacturing an article of jewelry comprising the steps of:

forming a wax model having opposing retaining walls that form a channel for seating a gem therein, said wax model having a certain degree of resiliency enabling flexing of the side walls to allow entry of a gem into said channel;

mechanically cutting wax in the opposing retaining walls of the formed wax model to form seating grooves that engage a girdle of said gem below a distal edge of each opposing retaining wall;

snapping said gem into the channel to allow said girdle to enter into engagement into said seating grooves;

forming an investment mold about said gem and wax model;

using the lost wax process to replace the wax model with cast precious metal within the investment mold;

devesting the investment mold to release the formed article of jewelry with the set gem thereon.

2. The method as defined in claim 1 further comprising the steps of;

using a pointed tool to cut the wax away and form the seating grooves to follow the contour of the girdle of the gem.

3. A method as defined in claim 2 wherein said pointed tool has a side extending blade portion extending only to one side of said tool for fitting in the channel between said opposing retaining walls and to cut away the wax along one retaining wall at a time.

4. The method as defined in claim 1 further comprising the steps of;

sliding a positioning ledge of the tool along the distal edge of the retaining wall and having a pointed distal end of the tool cut into said retaining wall spaced from the distal edge for the removal of wax from the seating grooves.

5. A method as defined in claim 4 further comprising;

sliding said positioning ledge of the tool a sufficient distance to cut the seating grooves sufficiently long to seat a plurality of gem stones therein.

* * * * *